US008621768B2

(12) United States Patent
Robinson, Jr. et al.

(10) Patent No.: US 8,621,768 B2
(45) **Date of Patent: *Jan. 7, 2014**

(54) GOLF SHOE

(75) Inventors: Douglas K. Robinson, Jr., Mansfield, MA (US); John J. Erickson, Brockton, MA (US)

(73) Assignee: Acushnet Company, Fairhaven, MA (US)

( * ) Notice: Subject to any disclaimer, the term of this patent is extended or adjusted under 35 U.S.C. 154(b) by 285 days.

This patent is subject to a terminal disclaimer.

(21) Appl. No.: 13/036,681

(22) Filed: Feb. 28, 2011

(65) Prior Publication Data

US 2011/0203140 A1 Aug. 25, 2011

Related U.S. Application Data

(63) Continuation of application No. 11/935,454, filed on Nov. 6, 2007, now Pat. No. 7,895,773.

(51) Int. Cl.
*A43B 5/00* (2006.01)
*A43B 7/14* (2006.01)

(52) U.S. Cl.
USPC ..... 36/127; 36/134; 36/153; 36/154; 36/28

(58) Field of Classification Search
USPC ..... 36/127, 28, 29, 35 B, 37, 71, 35 R, 141, 36/91, 92, 153, 154
See application file for complete search history.

(56) References Cited

U.S. PATENT DOCUMENTS

| | | | | |
|---|---|---|---|---|
| 4,682,425 | A | 7/1987 | Simmons | |
| 4,875,683 | A | 10/1989 | Wellman et al. | |
| 5,155,927 | A | 10/1992 | Bates et al. | |
| 5,493,792 | A | 2/1996 | Bates et al. | |
| 6,038,790 | A | 3/2000 | Pyle et al. | |
| 6,161,315 | A | 12/2000 | Dalton | |
| 6,408,543 | B1 | 6/2002 | Erickson et al. | |
| 6,598,321 | B2 | 7/2003 | Crane et al. | |
| 6,796,056 | B2 | 9/2004 | Swigart | |
| 7,200,955 | B2 | 4/2007 | Foxen | |
| 7,895,773 | B2 * | 3/2011 | Robinson et al. | 36/127 |
| 2002/0083618 | A1 | 7/2002 | Erickson et al. | |
| 2006/0026868 | A1 | 2/2006 | Grisoni et al. | |
| 2006/0130361 | A1 | 6/2006 | Robinson et al. | |
| 2007/0028485 | A1 | 2/2007 | Crane et al. | |

* cited by examiner

*Primary Examiner* — Jila M Mohandesi
(74) *Attorney, Agent, or Firm* — Daniel W. Sullivan

(57) ABSTRACT

A golf shoe having an upper, a midsole, and an outsole is provided. A collapsible support element is positioned in a recess proximate to a wearer's first metatarsal bone. The collapsible support element has anisotropic mechanical properties and includes a series of longitudinal wave elements. The wave elements are stiffer in a longitudinal direction and more collapsible in a transverse direction. The wave elements resist collapsing when a golfer walks but have a propensity to collapse during the golfer's swing, which allows more efficient transfer of energy during the swing. The shoe further includes flexing channels in a forward portion as well as a flexing channel in the rear portion.

9 Claims, 7 Drawing Sheets

GOLF SHOE

CROSS-REFERENCE TO RELATED APPLICATIONS

The present invention is a continuation of U.S. application Ser. No. 11/935,454 filed on Nov. 6, 2007, now U.S. Pat. No. 7,895,773, the disclosure of which is incorporated herein in its entirety

FIELD OF THE INVENTION

The present invention relates generally to shoes. More particularly, the present invention relates to golf shoes including collapsible support elements with anisotropic mechanical properties.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal.

The game of golf includes long stretches of walking and short moments of swinging a golf club to hit a golf ball. Consequently, golf shoes have evolved to provide the wearer with good traction on grass, comfort while walking, and a stable platform for hitting the ball. Typical golf shoes thus have a relatively stiff sole with metal spikes or plastic cleats. Some golf shoes also include gels that cushion the impact of so-called "ground reaction forces" on the foot. From Newton's Third Law of Motion, the law of action-reaction, it is known that the ground pushes on the foot in a direction equal and opposite to the direction the foot pushes on the ground; these are known as ground reaction forces.

Gels have been incorporated into the sole of athletic shoes. Conventional gels are generally pre-set to fit the contours of a foot or they are soft liquid gels that must be placed in a bladder. Some examples include U.S. Pat. Nos. 5,155,927 and 5,493,792 to Bates, which disclose athletic shoes constructed to minimize impact shock and maximize lateral stability by use of a cushioning element comprising a chamber having flexible walls filled with a liquid composition which is preferably a gel and the chamber has a plurality of partitions for directing the flow of liquid from one portion of the chamber to another.

However, there remains a need in the art for golf shoes having collapsible support elements that minimize the impact of ground reaction forces when walking, and that allow more efficient transfer of energy during a golf swing.

SUMMARY OF THE INVENTION

A golf shoe comprising an upper, a midsole, an outsole, and a collapsible support element positioned in a recess proximate to a wearer's first metatarsal bone. The collapsible support element is stiffer in a longitudinal direction and is more collapsible in a transverse direction, and is designed to collapse in the transverse direction during a golf swing to allow more efficient transfer of energy.

In one embodiment, the collapsible support element comprises a tapered gel pad comprising a thick outer end, a thin inner end, and a top surface comprising a plurality of support posts wherein the thick outer end is more collapsible than the thin inner end.

In another embodiment, the collapsible support element comprises a single element having a wave configuration in the longitudinal direction and a variable thickness profile in the transverse direction. The thickness profile decreases in thickness from an inner thickness to an outer thickness. Also, the thickness profile can be a smooth curvature, a stepped curvature, or a combination thereof. The single element can be encased in a gel pad.

In another embodiment, the collapsible support element comprises a series of longitudinal wave elements extending along the transverse direction, wherein the longitudinal wave elements change in frequency and orientation along the transverse direction. The inner longitudinal wave elements would have a higher wave frequency than outer longitudinal wave elements. Furthermore, the inner longitudinal wave elements can be more upright than outer longitudinal wave elements. Additionally, the inner longitudinal wave elements can have a thicker profile than the outer longitudinal wave elements.

For all embodiments, an optional second support element can be positioned in a recess beneath the midsole proximate to a wearer's calcaneus. The second support element can also be stiffer in a longitudinal direction and is more collapsible in a transverse direction.

The golf shoe may further comprise at least one flexing channel in a forward portion of a sole of the shoe and at least one flexing channel in a rear portion of the sole of the shoe. The golf shoe may also be used with replacement cleats that can have the same dimensions as the original cleats or can be a lower height than the original cleats to account for the wear and tear of the shoe.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE INVENTION

Figure 1:
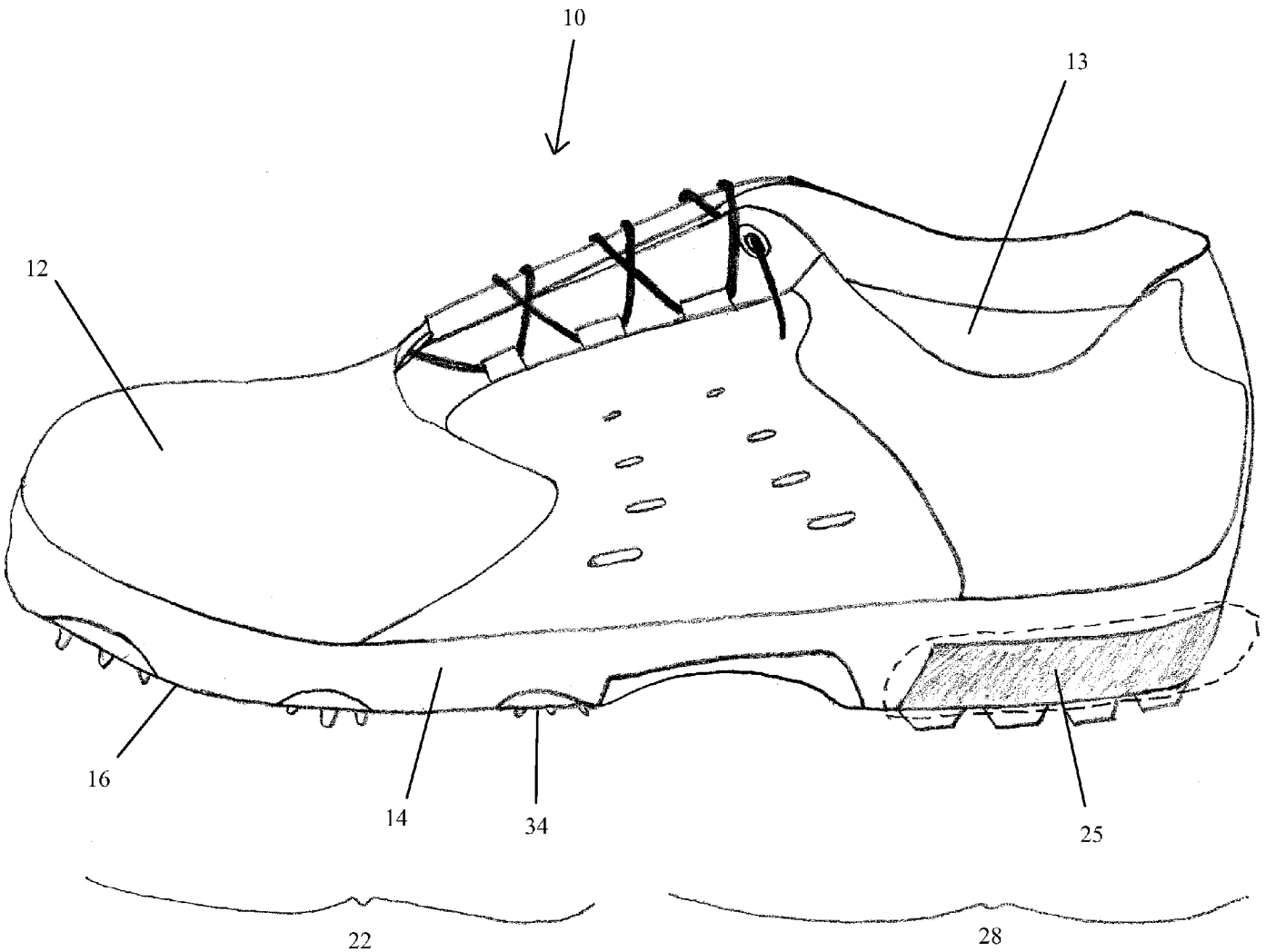
FIG. 1 is a top, perspective view of a golf shoe of the present invention.
Figure 2:
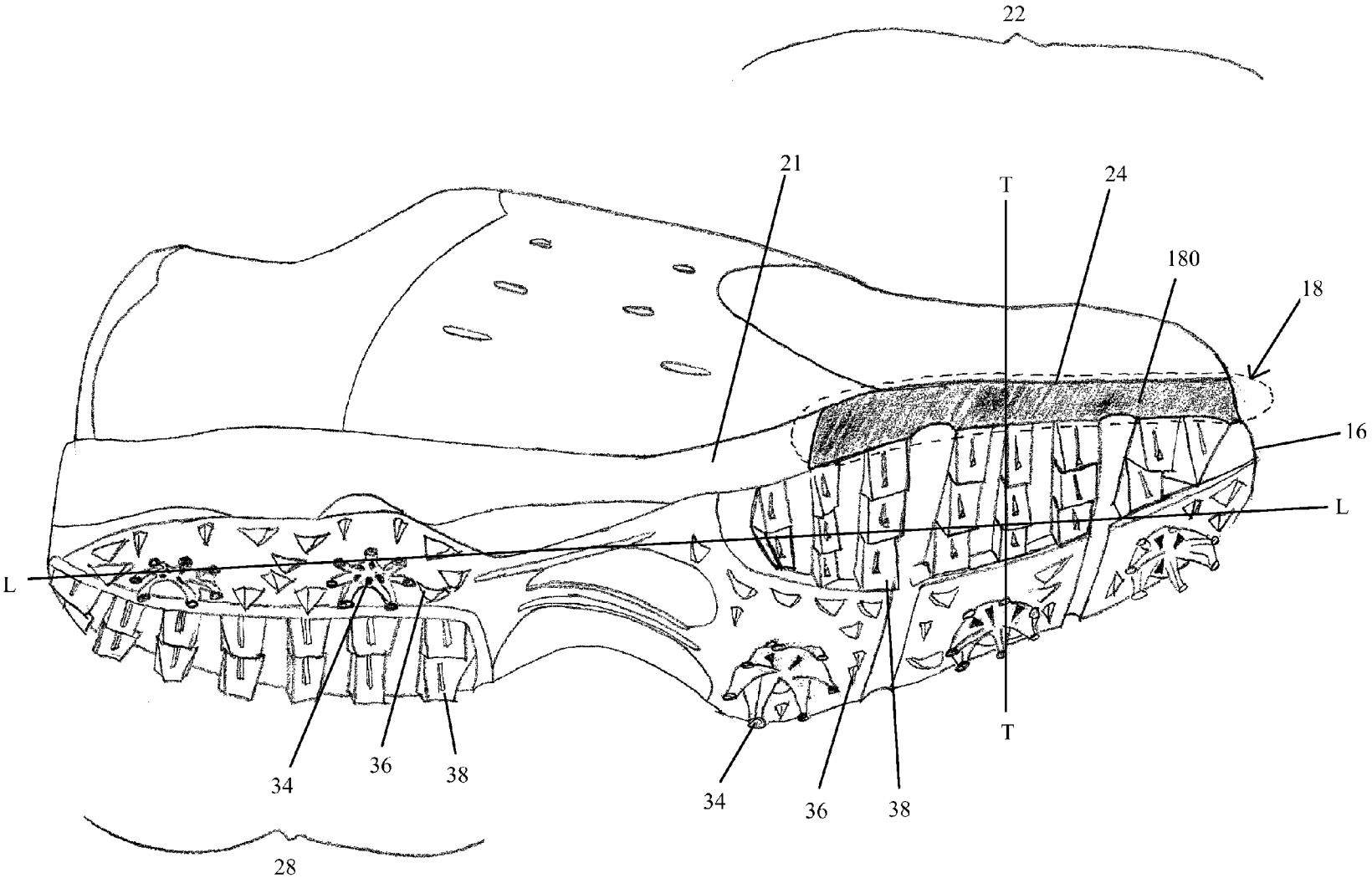
FIG. 2 is a bottom perspective view of an outsole of the present golf shoe showing a gel pad with anisotropic mechanical properties.
Figure 3:
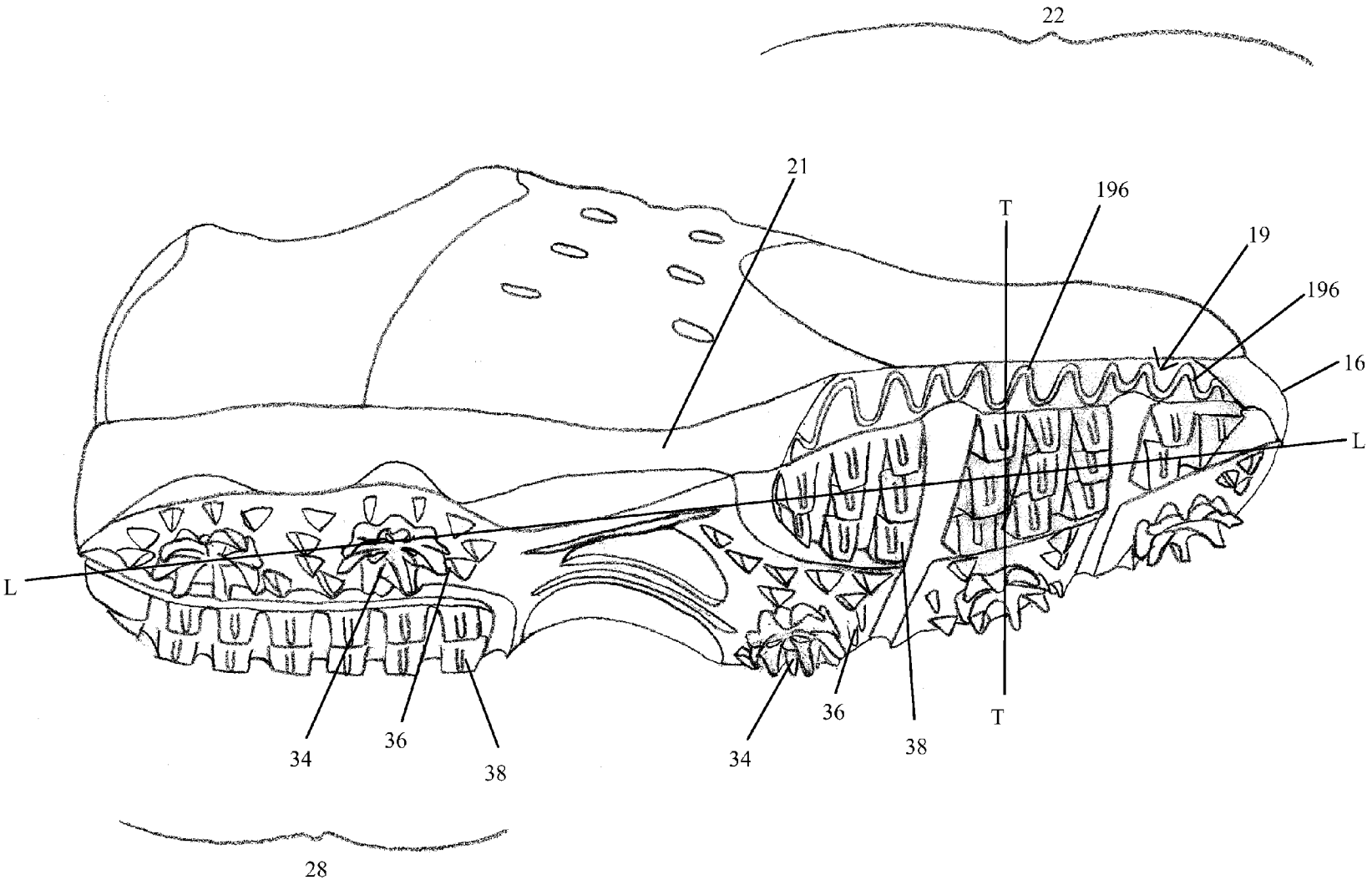
FIG. 3 is a bottom perspective view of an outsole of the present golf shoe showing a single collapsible supporting element with anisotropic mechanical properties.
Figure 4:
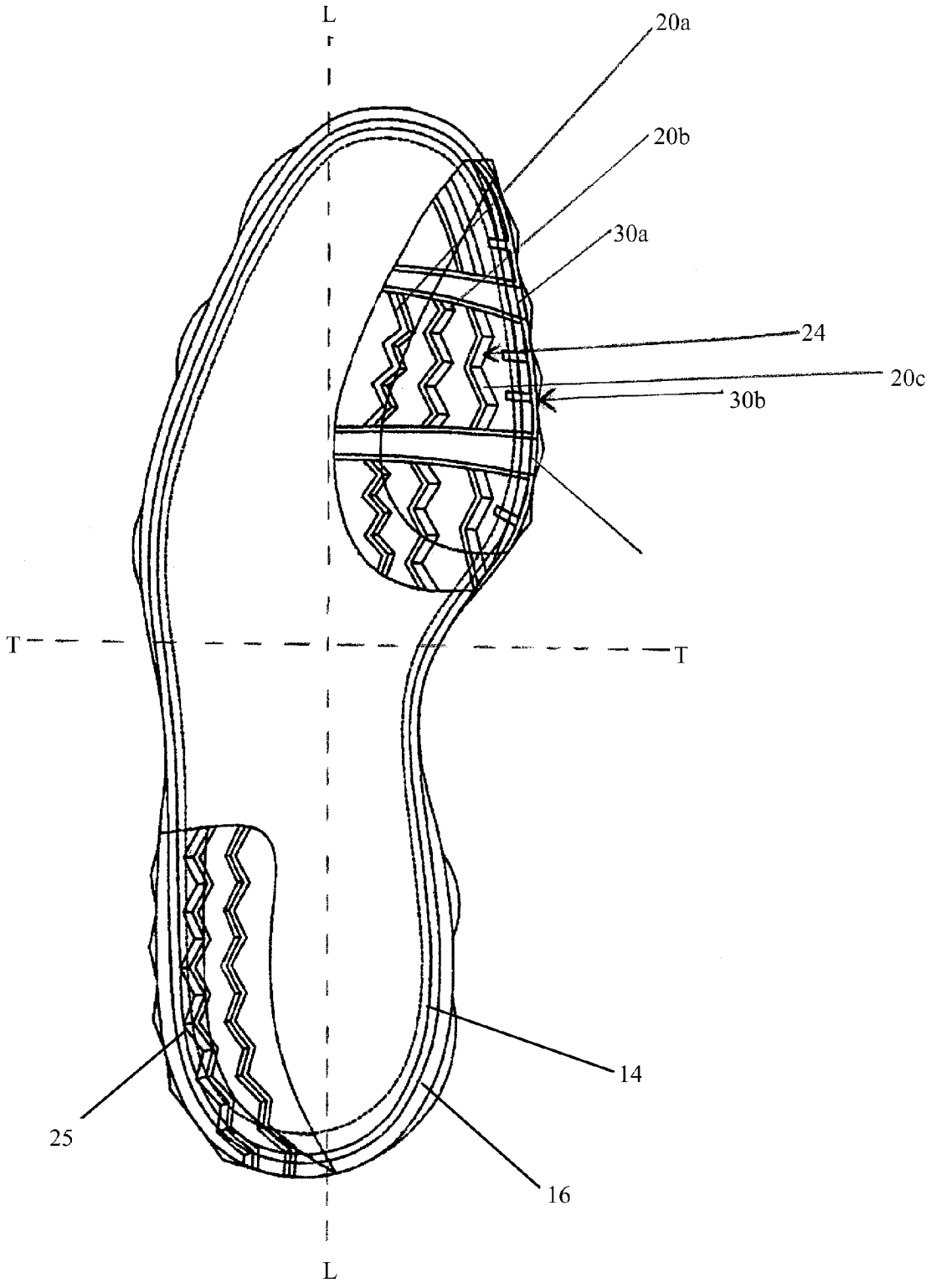
FIG. 4 is a top view of a golf shoe of the present invention with portions broken away to expose a series of collapsible supporting elements with anisotropic mechanical properties.
Figure 5:
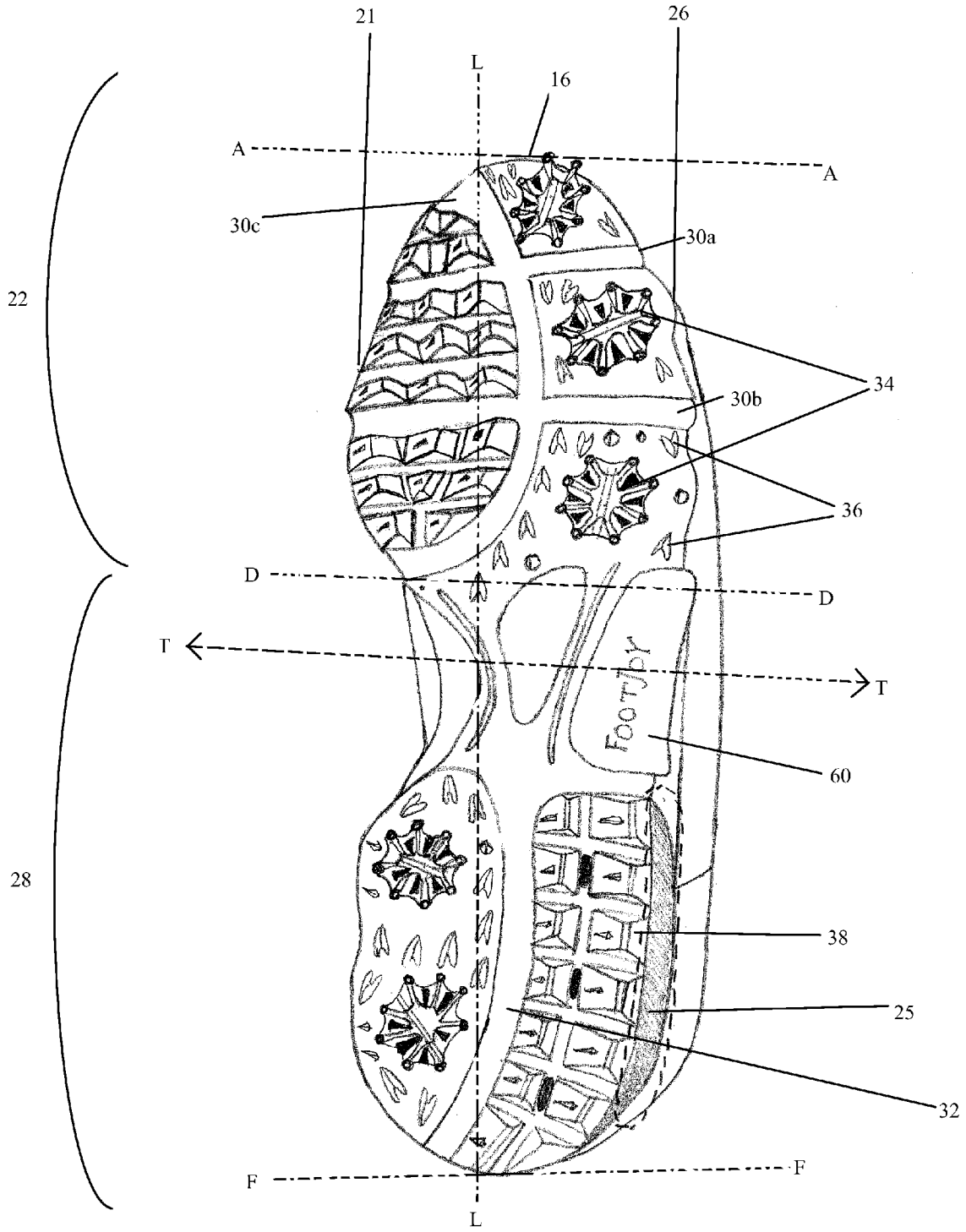
FIG. 5 is a bottom view of an outsole of the present golf shoe.

As shown in FIGS. 1-5, shoe 10 includes an upper 12, a midsole 14 joined to the upper 12, and an outsole 16 joined to the midsole 14. In an advantageous aspect of the present invention, outsole 16 includes at least one toe collapsible support element 24 encased in a recess of the outsole 16 and that attenuates ground reaction forces experienced by the forefoot during a golf swing. More specifically, the collapsible support element 24 can be a collapsible gel pad 18 encased in a thermoplastic urethane (shown in FIGS. 2 and 6A-6B), or a single collapsible supporting element 19 with anisotropic mechanical properties (shown in FIGS. 3 and 7), or a series of collapsible supporting elements 20 with anisotropic mechanical properties (shown in FIG. 4). Each embodiment, of the collapsible support element 24, resists collapsing when a golfer walks, however each has a propensity to collapse in the transverse direction when the golfer swings therein allowing a more efficient transfer of energy during the golf swing. Such collapsible support elements 24 are strategically located on the medial side 21 of forward portion 22 in order to assist in weight transfer during the golf swing. Optionally, as shown in FIGS. 1, 4 and 5, heel support element(s) 25 can be located on rear portion 28 in order to absorb shock during walking. Heel support element 25 can also be gel pad 18, single collapsible support 19 or multiple collapsible supports 20. Toe support element 24 and heel support element 25 can be made from the same or different materials. In another advantageous aspect of the present invention, golf shoe 10 comprises flexing channels 30*a-c* in forward portion 22 as well as a flexing channel 32 in rear portion 28. Golf shoe 10 also has projections 34, 36, 38, commonly referred to as "spikes" and "cleats," which protrude from the bottom surface of outsole 16 and can have variable heights.

All components shown in the FIGS. 1-5 are for a left shoe, the components for a right shoe being mirror images thereof. As used herein, "medial side" 21 refers to the inside peripheral edge of the shoe and "lateral side" 26 refers to the outside peripheral area of the shoe. As used herein, "forward portion" 22 refers to that end of the shoe near the toes (approximately located between lines AA and DD shown in FIG. 5) and "rear portion" 28 refers to that end of the shoe near the heel (approximately located between lines DD and FF shown in FIG. 5).

Referring back to FIG. 1, upper 12 has a generally conventional shape and is formed from a suitable upper material, such as leather, synthetic materials, or combinations of these. An opening 13 is formed by the top portion of the upper 12 for receiving a user's foot. Upper 12 is preferably secured to midsole 14 by stitching or with cement or other adhesives using an insole board and conventional techniques, as known by those of ordinary skill in the art.

The midsole 14 provides cushioning to the wearer, and is formed of a material such as an ethylene vinyl acetate copolymer (EVA). Preferably, the midsole 14 is formed on and about the outsole 16. Alternatively, the midsole can be formed separately from the outsole and joined thereto, such as by adhesive. Once the midsole and outsole are joined, they form a substantial portion of the bottom of shoe 10.

When golfers swing, their feet typically move along a transverse axis T, as best shown in FIG. 5, extending between medial side 21 and lateral side 26, and more specifically along the metatarsal bones on each foot. When golfers walk, their feet typically move along the longitudinal axis L, extending between the heel and the toe. As the feet move along either transverse axis T or longitudinal axis L, they experience ground reaction forces that cause strain on muscles and bones. The collapsible support toe element 24 of the present invention attenuates the impact of such ground reaction forces and allows more efficient transfer of energy during a golf swing. Optional heel support element 25 provides additional cushioning support to the wearer.

During a golf swing, toe support element 24 is strategically located on medial side 21 of forward portion 22, under the first metatarsal bone and proximate to the hallux or big toe, in order to assist in weight transfer. Toe support element 24 can comprise a collapsible gel pad 18 encased in a shell, or a single collapsing element 19 with anisotropic mechanical properties, or a plurality of collapsing elements 20 with anisotropic mechanical properties, as discussed above. These support elements, located on the medial side 21 of the left and right shoes, collapse during a golf swing to allow more efficient transfer of energy during a golf swing. Structurally, toe support elements 18, 19, and 20 are all configured and dimensioned to fit within a recess underneath midsole 14. The recess extends from medial side 21 to a distance about half-way across midsole 14.

Figure 6A:
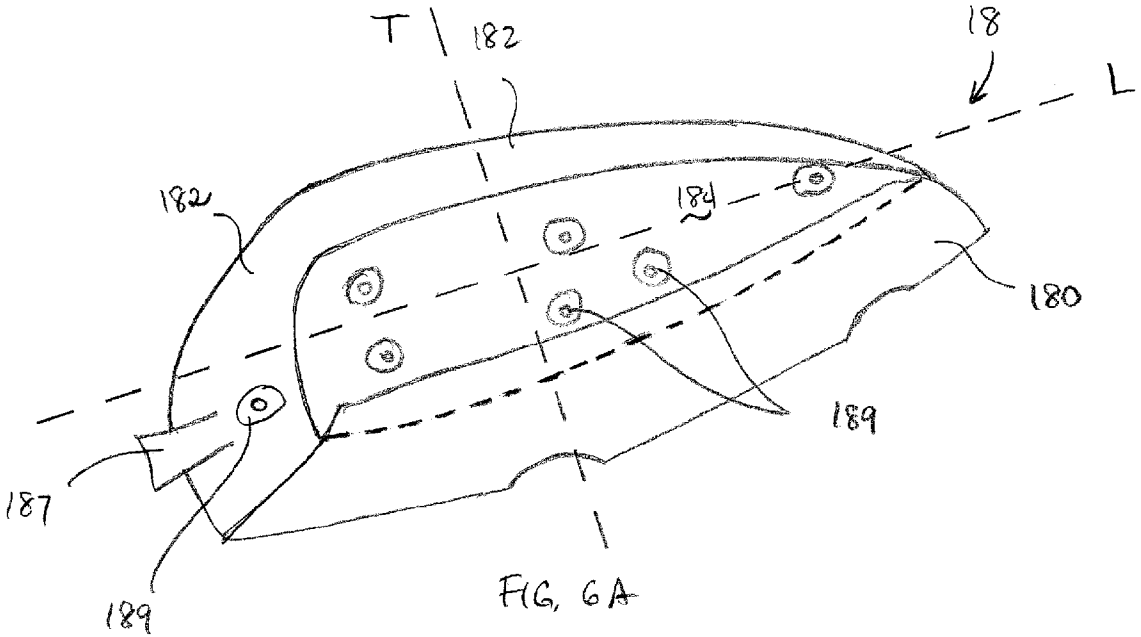
FIGS. 6A and 6B are the perspective and end views, respectively, of a gel pad in accordance to the present invention.
Figure 6B:
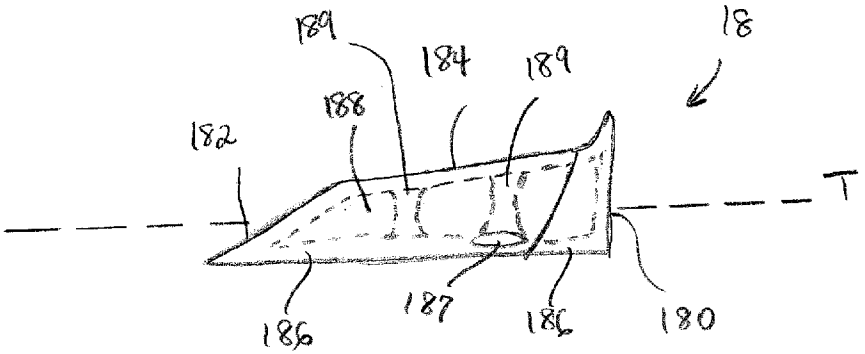

As shown in FIGS. 6A and 6B, collapsible gel pad 18 has a generally tapered profile. Outer edge 180 is exposed at medial side 21, as shown in FIG. 2, and is the thickest portion of gel pad 18. Opposite to outer edge 180 is thin edge 182. Top surface 184 is disposed between edges 180 and 182. Gel pad 18 comprises shell 186, which encases a soft gel 188. Since outer edge 180 is significantly thicker than thin edge 182, there is more gel near the outer edge of gel pad 18, so that the outer portion of gel pad 18 has a higher tendency to collapse than the inner section proximate to thin edge 182. Additionally, a plurality of support posts 189 are disposed between soft outer edge 180 and rigid inner edge 182. Support posts 189 minimize the tendency of the middle section of gel pad 18 under top surface 184 to collapse. Support posts 189 can be hollow and can be molded into shell 186.

The relatively rigid thin edge 182 and support posts 189 singly or in combination provide support for the golfer when walking along longitudinal axis L. While swinging the club along the transverse axis T, thin edge 182 singly or in combination with support posts 189 resist collapsing; however, unsupported thick outer edge 180 advantageously collapses to support the swing and to allow more efficient transfer of energy during a golf swing. Hence, gel pad 18 has anisotropic properties, i.e., resisting collapse in the longitudinal direction and tending to collapse in the transverse direction.

By way of example, one suitable gel for gel pad 18 comprises polydimethyl-siloxane and a suitable crosslinking agent. A benefit of using such a silicone gel is that it does not leach out oil over time like rubbers/oil mixtures. Therefore, it is suitable for use next to materials such as leather. The gel has a durometer value between about 5 to 70 Shore A, a penetration value of about 300 units or above, and a viscosity value of about 1500 cps to about 2500 cps. The gel is poured into the thermoplastic urethane shell 186 to form the gel pad 18. A fill port 187 is provided for the injection of silicone gel after shell 186 is molded.

Figure 7:
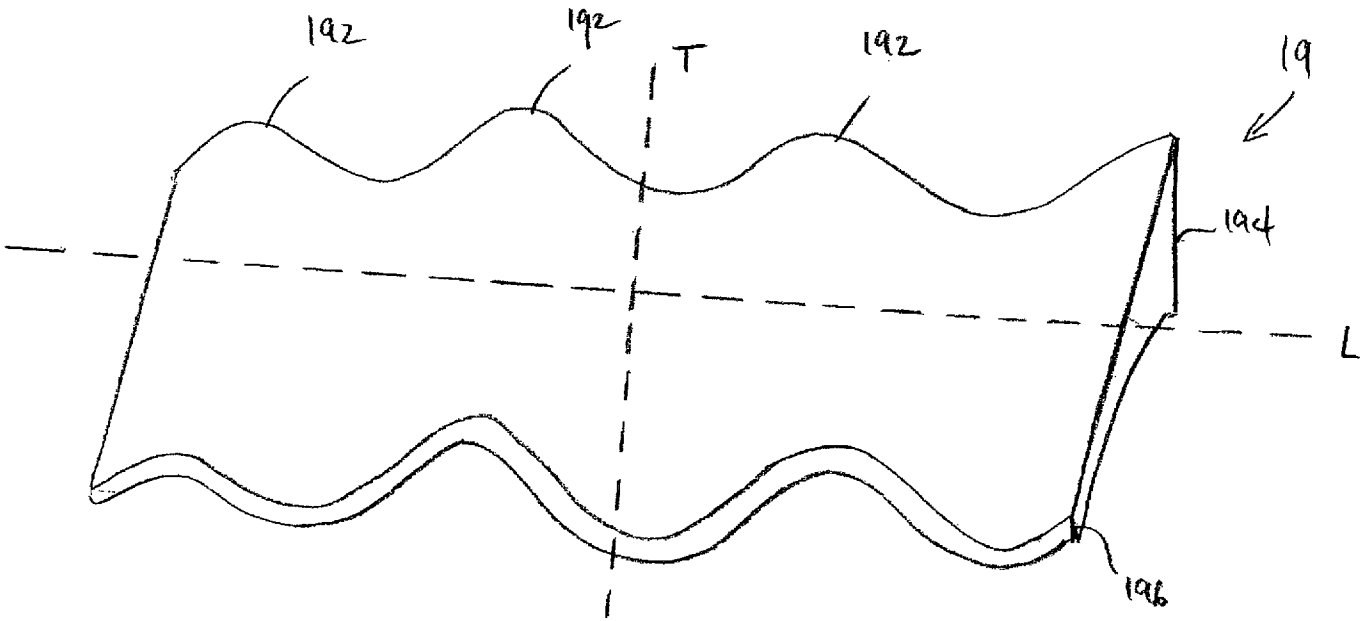
FIG. 7 is a schematic diagram of a single collapsible support element with anisotropic mechanical properties.
Figure 7C:
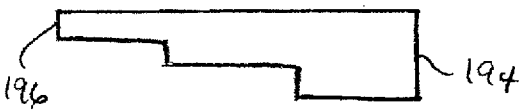
FIGS. 7A-7C are possible thickness profiles of the single collapsible support element of FIG. 7.
Figure 7B:
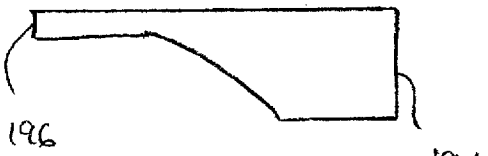
Figure 7A:
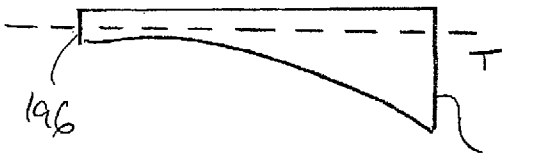

As shown in FIGS. 3 and 7, in another embodiment of the present invention, the support element comprises a single collapsible support element 19 with anisotropic mechanical properties. More specifically, in this embodiment, element 19 is preferably made from a longitudinal wave configuration with the wave propagating along the longitudinal L axis. Single collapsible support element 19 also has a variable thickness in transverse direction T wherein inner thickness 194 is thicker than outer thickness 196. The thickness profile of single element 19 can be any smooth curvature, as shown in FIG. 7A, stepped curvature, as shown in FIG. 7C, or any combination of both, as shown in FIG. 7B. The present invention is not limited to any thickness profile. When inserted into shoe 10, inner thickness 194 is positioned inside midsole 14 and outer thickness 196 is positioned proximate to medial edge 21, as shown in FIG. 3. When the golfer walks along longitudinal axis L, the thicker portion 194 of single collapsible support element 19 supports the shoes thereby minimizing the tendency to collapse. When the golfer swings the club and rolls his or her feet along the transverse direction T, the thinner portion 196 collapses to allow more efficient transfer of energy during a golf swing.

Single collapsible support element 19 can be also encased in a collapsible gel pad 19, discussed above. Single element 19 can be made from a thermoplastic or thermoset polymer preferably thermoplastic elastomer or thermoplastic polyurethane.

As shown in FIG. 4, in yet another embodiment of the present invention, the inventive collapsible support element 24 can comprise a series of collapsible support elements 20 with anisotropic mechanical properties. Elements 20 may comprise a series of waves 20*a*-20*c*, where the wave frequency and orientation of waves 20*a-c* gradually change as they extend from the inside of the shoe toward the outside of the shoe along the transverse T axis. More specifically, inner wave 20*a* has a relatively high wave frequency and is relatively upright. The next outer wave 20*b* decreases in wave frequency and is more slanted than wave 20*a*. The next outer wave 20*c* preferably has an even lower frequency and is even more slanted than waves 20*a* and 20*b*. The relative frequency of waves 20*a-c* and their orientation are illustrated in FIG. 4. Although only three waves 20*a*-20*c* are illustrated, any number of waves can be utilized. Waves with higher frequency and more upright profile are stiffer than waves with lower frequency and more slanted profile, which have a higher tendency to collapse. Hence, while walking the golfer is supported by stiffer waves, such as waves 20*a* and 20*b*, since these waves are aligned generally in the longitudinal direction L. When the golfer swings the club and rolls his or her feet along transverse direction T, less stiff waves, such as waves 20*b* and 20*c* collapse or buckle to allow more efficient transfer of energy during a golf swing. Alternatively or additionally, waves 20*a*-20*c* can have varying thickness with the inner waves having a thicker profile than the outer waves.

Optionally, as shown in FIGS. 1, 4, and 5, a second or heel support element 25 can be located on lateral side 26 of rear portion 28 in order to absorb shock during walking. The heel support element 25 is configured and dimensioned to fit within a cavity underneath midsole 14 proximate to the calcaneus or heel bone. Heel support element 25 can extend from one edge to a distance that is about half-way across the midsole 14, or can extend all the way across the heel. Heel support element 25 can be a gel pad 18, a single anisotropic element 19, or a plurality of anisotropic elements 20.

In addition to support elements 18, 19, and 20, forward portion 22 also has a series of flexing channels 30*a-c* (best shown in FIG. 5) that run transversely and longitudinally through it. More specifically, flexing channel 30*a* is preferably located such that it will be generally beneath the phalanges area, while the second flexing channel 30*b* is preferably located such that it will be substantially below the user's first metatarsal bones. The middle of the second flexing channel 30*b* is preferably located directly under the metatarsal heads. This optimally allows for variability of the location of metatarsal heads by being wider than the flexion axis of the metatarsal heads. Flexing channel 30*c* runs longitudinally down forward portion 22. In an advantageous aspect of the present invention, rear portion 28 also has a flexing channel 32 that runs longitudinally down rear portion 28. Thus, flexing channels 30*a-c* and 32 are designed and positioned to define predetermined bending regions for more comfortable walking.

The flexing channels 30*a-c* and 32 may be formed of a thermoplastic urethane that is substantially soft for additional flexibility of the forward portion 22 and rear portion 28. Preferably, the flexing channels 30*a-c* and 32 have a hardness of less than about 85 Shore A and more preferably about 70 Shore A. One recommended material is currently manufactured by TAIWAN URE-TECH CO., LTD. under the name U-70AP and has a Shore A of about 70. The outsole 16 of the present invention may be formed by various conventional methods. For example, one recommended method is disclosed in U.S. Pat. No. 5,979,083 issued to Robinson et al., which is hereby incorporated by reference in its entirety. According to this method, first and second layers are molded together.

Preferably, materials for the first layer and second layer have a hardness of at least about 70 Shore A. More preferably, the material hardness is at least about 80 Shore A, and most preferably of about 95 Shore A±3 Shore A. Suitable materials for the first and second layers include without limitation thermoplastic and thermosetting polymers such as thermoplastic urethanes. A specific material of preference is a thermoplastic urethane, U-95A, manufactured by TAIWAN URE-TECH CO., LTD. Other applicable thermoplastic urethanes include Desmopan® from Bayer and Pebax® from Atofina.

As shown in FIGS. 1-3 and 5, outsole 16 includes a series of projections 34, 36, 38, commonly referred to as "spikes" and "cleats," which protrude from the bottom surface of outsole 16 in order to provide traction with the ground.

Cleats 34 are replaceable when worn and are releasably retained in cleat receptacles (not shown) which are retained in sockets (not shown). While only five replaceable cleats 34 are shown, any number of cleats 34 can be used, e.g. up to 7-9 cleats 34 can be arranged on outsole 16. The recommended cleats 34 are commercially available from the manufacturer SOFTSPIKES®. These cleats 34 are formed of a polyurethane that is softer than the material of spikes 36, 38, which are permanent. Spikes 36 and 38 are substantially stiffer than cleats 34 to minimize wear and tear, since spikes 36, 38 are not replaceable.

The height of spikes and cleats 34, 36, 38 is determined so that the proper amount of traction is provided. In one embodiment, the height of the softer cleat 34 is greater when not worn than the height of stiff spikes 36, 38 since cleats 34 bend when a golfer stands in shoes 10. Preferably, after a normal load is placed on shoes 10, cleats 34 are bent to substantially the same height as spikes 36, 38 to provide a flat walking surface.

Spikes 36, 38 are worn after normal wear; however, unlike cleats 34 spikes 36, 38 cannot be replaced. Thus, in accordance to one aspect of the present invention, when replacing cleats 34, the golfer can strategically choose the height of replacement cleats 34 to match the height of worn spikes 36, 38. By way of example, if cleats 34 are replaced after a relatively short amount of time (e.g., two months), then replacement cleats 34 would preferably have the same height as original cleats 34 because it is unlikely that spikes 36, 38 have diminished significantly in height. By contrast, if cleats 34 are replaced after a relatively long amount of time (e.g., one year), then replacement cleats 34 would preferably have a shorter height than original cleats 34 because it is likely that projections 36, 38 have diminished in height. Hence, it is advantageous to golf shoe manufacturers to provide golfers with replaceable cleats 34 of varying heights and instructions guiding the golfer's selection.

A logo assembly 60 is positioned along a portion of outsole 16 and may include a transparent layer material to protect the logo when the outsole contacts the ground and permit visibility of the logo. One preferred material for the logo assembly 60 is an ester-based thermoplastic polyurethane manufactured by TAIWAN URE-TECH CO., LTD. under the name UTY-90A, having a Shore A of about 90.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with feature(s) and/or element(s) from other embodiment(s). Therefore, it will be understood that the appended claims are intended to cover all such modifications and embodiments, which would come within the spirit and scope of the present invention.

We claim as our invention:

1. A golf shoe comprising an upper, a midsole, and an outsole, the outsole having a recess defined in a forward portion along a medial side of the outsole proximate to a wearer's first metatarsal bone;

a collapsible support element with anisotropic mechanical properties disposed in the recess, the support element comprising a series of longitudinal wave elements extending along the transverse direction, wherein the longitudinal wave elements change in frequency and orientation along the transverse direction, the wave elements being stiffer in a longitudinal direction and more collapsible in a transverse direction; and wherein the wave elements support a golfer's feet when walking and collapses in the transverse direction during a golf swing top to allow for a more efficient transfer of energy.

2. The golf shoe of claim 1, wherein the shoe comprises at least one flexing channel in a forward portion of a sole of the shoe and at least one flexing channel in a rear portion of the sole of the shoe.

3. The golf shoe of claim 1, wherein inner longitudinal wave elements have a higher wave frequency than out longitudinal wave elements.

4. The golf shoe of claim 3, wherein inner longitudinal wave elements are more upright than outer longitudinal wave elements.

5. The golf shoe of claim 4, wherein inner longitudinal wave elements have a thicker profile than outer longitudinal wave elements.

6. The golf shoe of claim 1, wherein a second support element is positioned in a cavity beneath the midsole proximate to a wearer's calcaneus, wherein the second support element is stiffer in a longitudinal direction and more collapsible in a transverse direction.

7. The golf shoe of claim 6, wherein the second support element comprises a tapered gel pad comprising a thick outer edge, a thin inner edge, and a top surface comprising a plurality of posts, and a shell containing a gel therein.

8. The golf shoe of claim 7, wherein the second support element comprises a single element having a wave configuration in the longitudinal direction and a variable thickness profile in the transverse direction.

9. The golf shoe of claim 8, wherein the second support element comprises: a series of longitudinal waves extending along the transverse direction, wherein the longitudinal waves change in frequency and orientation along the transverse direction.

* * * * *